United States Patent [19]

Zimmern

[11] Patent Number: 4,890,461

[45] Date of Patent: Jan. 2, 1990

[54] HERMETIC OR SEMI-HERMETIC REFRIGERATION MOTOR-COMPRESSOR UNIT

[76] Inventor: Bernard Zimmern, 6 New St., East Norwalk, Conn. 06855

[21] Appl. No.: 217,223

[22] Filed: Jul. 11, 1988

[30] Foreign Application Priority Data

Jul. 21, 1987 [FR] France ..... 87 10273

[51] Int. Cl.[4] ..... F25B 41/00

[52] U.S. Cl. ..... 62/197; 62/505

[58] Field of Search ..... 62/505, 197

[56] References Cited

U.S. PATENT DOCUMENTS

| | | | |
|---|---|---|---|
| 3,180,565 | 4/1965 | Zimmern | 418/99 |
| 3,192,735 | 7/1965 | Bernhard | 62/505 |
| 3,232,074 | 2/1966 | Weller et al. | 62/505 |
| 3,379,033 | 4/1968 | Grant | 62/505 |
| 3,618,337 | 11/1971 | Mount | 62/505 |
| 3,698,839 | 10/1972 | Distefano | 417/299 |
| 3,805,547 | 4/1974 | Eber | 62/505 |
| 3,838,581 | 10/1974 | Endress | 62/505 |
| 3,866,438 | 2/1975 | Endress | 62/505 |
| 3,885,402 | 5/1975 | Moody, Jr. et al. | 62/505 |
| 3,898,862 | 8/1975 | Kerschbaumer et al. | 62/197 |
| 3,913,346 | 10/1975 | Moody, Jr. et al. | 62/505 |
| 3,945,219 | 3/1976 | Kasahara | 62/469 |
| 4,261,691 | 4/1981 | Zimmern et al. | 417/440 |
| 4,509,341 | 4/1985 | Zimmern | 62/512 |
| 4,553,399 | 11/1985 | Noda et al. | 62/84 |
| 4,573,324 | 3/1986 | Tischer et al. | 62/115 |

FOREIGN PATENT DOCUMENTS

| | | |
|---|---|---|
| 1331998 | 6/1963 | France . |
| 2541437 | 8/1985 | France . |
| 1555330 | 11/1979 | United Kingdom . |

*Primary Examiner*—Ronald C. Capossela

*Attorney, Agent, or Firm*—Young & Thompson

[57] ABSTRACT

Liquid from the condenser 34 is supplied to the inner-space of the motor through pipe 11 and flashes therein while cooling the motor. The resulting gas is sent through pipe 10 to an economizer hole 9 of the compressor. At full load, hole 9 is at a higher pressure than the intake of the compressor. At part load, hole 9 is at a pressure close to the intake pressure. A piston 12 is subjected on one face to the economizer hole pressure and on the other face to the intake pressure. When both pressures tend to be equal, piston 12 travels to shoulder 16 and establishes therewith a pressure drop elevating the pressure in motor housing 7, thereby to maintain in motor housing 7 a pressure able to urge liquid from the motor casing to the evaporator 37 through pipe 38.

8 Claims, 1 Drawing Sheet

HERMETIC OR SEMI-HERMETIC REFRIGERATION MOTOR-COMPRESSOR UNIT

Figure 1:
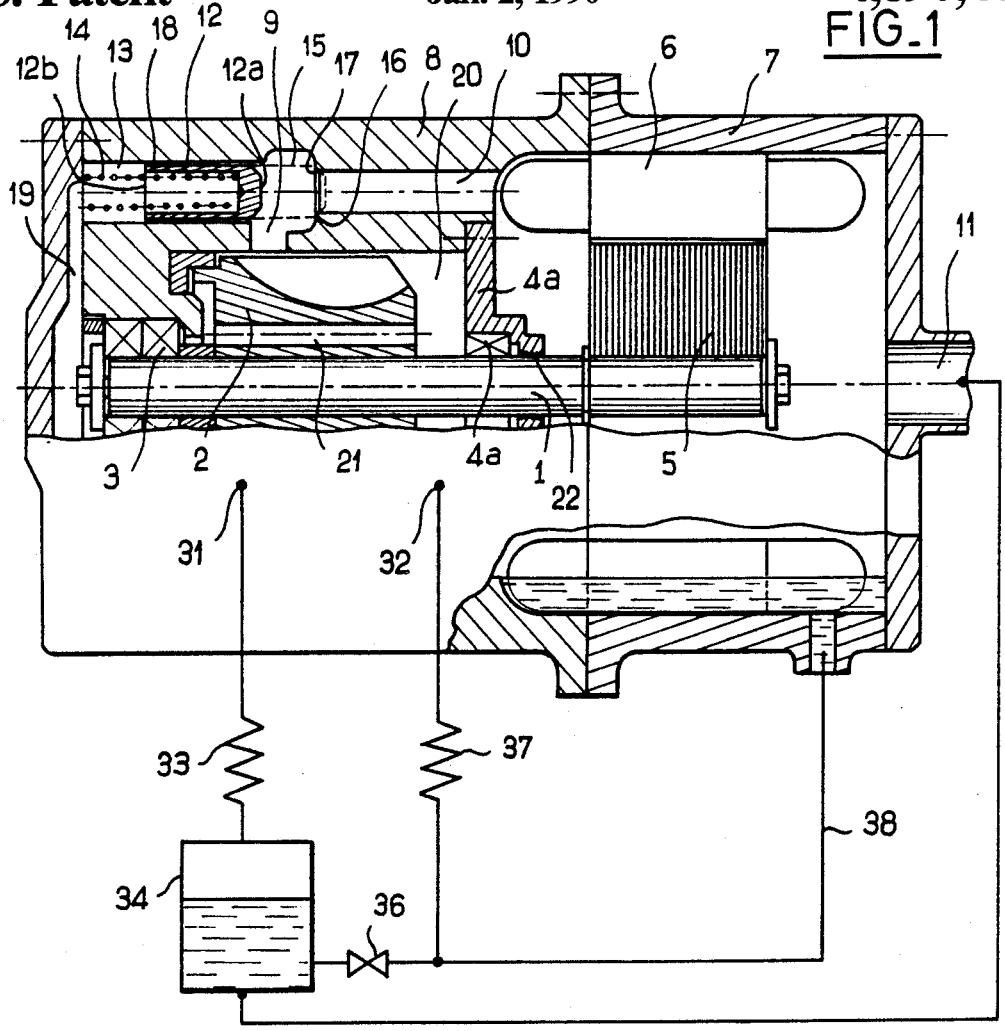

This invention relates to hermetic or semi-hermetic refrigeration motor-compressor units provided with an economiser.

According to a generally admitted phraseology, hermetic motor-compressor units are those in which leak-tightness is obtained by welding, whereas semi-hermetic motor-compressor units are those in which leak-tightness is performed by releasable connections and seals.

Semi-hermetic or hermetic refrigeration motor-compressor units are known in which the motor is cooled by gas or liquid or a combination of gas and liquid coming from the condenser of the refrigeration circuit. The gas including the volume of gas created by the vaporization needed to cool the motor is sent from the motor to an economiser hole of the compressor, said economiser hole being at a pressure intermediate between intake pressure and discharge pressure of the compressor.

Examples of such motor-compressor units are given by U.S. Pat. Nos. 4,553,399 and 4,573,324.

Sending to the economiser hole the gas resulting from the cooling flow through the motor is more advantageous than sending said gas to the intake of the compressor because this allows the compressor to use its entire intake capacity for intaking gas from the evaporator. In other words, the use of a part-flow for cooling the motor does not result in a reduction of the refrigerating capacity of the machine.

When a compressor such as a screw compressor is operated at part load, separation between each compression chamber and the intake of the compressor is delayed until said chamber has substantially reduced its volume. This reduces the effective capacity of each chamber, and thus the capacity of the machine. In such conditions, each chamber is being closed when it soon or already registers with the economiser hole. Thus, the pressure in the economiser hole becomes close to intake pressure and the motor is no longer at an intermediate pressure between intake and discharge. This generates a lot of problems as it becomes, for instance, difficult to move the liquid from the motor to the evaporator, particularly if the evaporator is disposed at a higher level than the motor.

The object of the invention is to overcome such problems.

According to the invention, there is provided a refrigeration motor-compressor unit comprising a positive displacement rotary compressor driven by a motor, means for injecting refrigerating fluid in an innerspace of the motor for cooling the motor, said innerspace being connected by a piping to an economiser hole of said compressor, characterized by a closure means disposed in said piping for at least partially obturating said piping, said closure means being connected to an intake pressure of said compressor and being adapted to clear said piping when the pressure at said economiser hole exceeds a predetermined differential level above said intake pressure.

When the compressor is operating at part-load, the pressure at the economiser hole falls to—or close to—intake pressure; in such a case, the closure means restricts flow and this establishes, upstream of the restriction, a pressure which is preferably controlled by a spring thrust; it is therefore possible to maintain in the motor a minimum pressure useful to expell from the motor innerspace any liquid which is separated from the gas.

However, when the compressor operates at full-load, this restriction would damage the efficiency as it would create a pressure drop between the motor and the economiser and lead to feed the economiser with economiser gas at a pressure which would be lowered by the closure means.

This drawback is avoided because the flow restriction exists only below a predetermined threshold of the differential pressure. Above said threshold, the closure means allow substantially free communication between motor innerspace and economiser hole.

To minimize volumes taken by the piping, the piston may be mounted in an extension of a piping between the motor innerspace and the economiser hole and in case of a differential pressure exceeding the threshold, the piston retracts past the economiser hole so that the piping between economiser hole and motor innerspace is entirely free of any piston obstruction when the compressor is at full-load. This is achieved by setting the spring such that its load be slightly smaller than the load created on the piston by the differential pressure when equal to the threshold.

Figure 2:
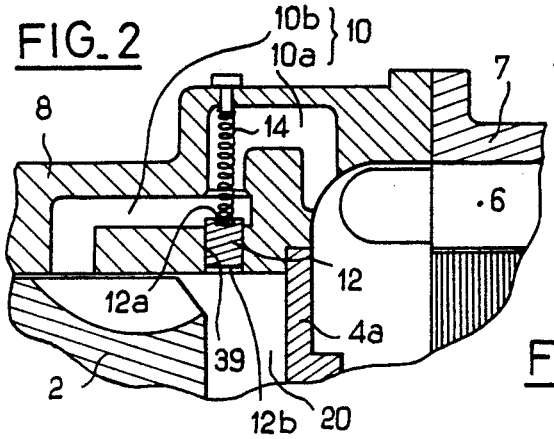
Figure 3:
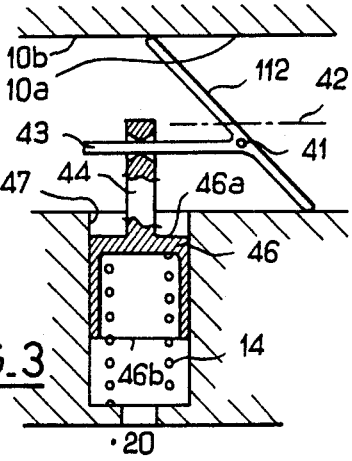

This invention will be better understood while reading the following description of non limiting examples with reference to the accompanying drawings in which :

FIG. 1 shows partially in cross-section a motor-compressor unit according to the invention, and diagrammatically the appendant refrigerating circuit; and FIGS. 2 and 3 are sectional part views of a second and a third embodiment of the compressor unit.

A shaft 1 (FIG. 1) carries a screw 2 cooperating with gate rotors—not shown—as is well known from e.g. U.S. Pat. No. 3,180,565. This shaft is supported by bearings 3 and 4 and driven in rotation by an electrical motor made of a rotor 5 attached to shaft 1 beyond bearing 4 and rotating inside a stator 6 which is stationary within a housing 7 attached to a casing 8 of the compressor.

Except for fluid connections to be described later, the housing 7 is leak-tight and the inner space of housing 7 is leak-tightly separated from an intake 20 of the compressor by a bearing holder **4*a* carrying bearing 4. Bearing holder 4*a* is provided with a sealing device 22 cooperating with shaft 1**.

A discharge port 31 of the compressor is connected to an intake port 32 of the compressor through a refrigerating circuit comprising in series in the following order: a condenser 33, a tank 34, an expansion valve 36 and an evaporator 37.

The casing 8 is provided with an economiser hole 9 as described in many patents, e.g. U.S. Pat. No. 4,261,691, this hole being connected to the innerspace of the motor housing 7 by piping 10.

The motor is cooled by liquid and/or gas reaching the innerspace of the motor housing 7 by a pipe 11 shown here in the axis of the motor but which could be arranged at other places, for instance on the top of the motor.

This liquid and/or gas passes through the motor, while cooling the motor. The gas having cooled the motor is sucked by the compressor through economiser hole 9. The liquid and/or gas arriving in housing 7 through pipe 11 may be, as shown, liquid coming directly from the condenser 33 through a pipe and partially flashing inside the motor as disclosed by U.S. Pat.

No. 4,573,324; lit may also be liquid with or without gas coming from a centrifugal economiser which would be mounted at the end of the shaft 1 beyond rotor 5. Such a centrifugal economiser is disclosed in U.S. Pat. No. 4,509,341. It could also be merely gas coming from a conventional economiser.

Whatever the case, the motor housing is generally used to separate liquid which is to be fed somewhere else. For instance, as shown and according to U.S. Pat. No. 4,573,324, liquid is collected in the bottom of the motor housing 7 and sent to the evaporator 37, through a duct 38, thanks to the pressure in housing 7 being higher than downstream of valve 36.

When using oil injection free compressors as taught in U.S. Pat. No. 4,553,399, the bottom of the motor housing is preferably used for collecting oil left from the liquid flashed by motor heat and sending it to the bearings.

In all cases, when the compressor operates at full-load, the pressure in the motor is substantially higher than the intake pressure of the compressor. When operating with refrigerant "R22", the differential pressure in a standard air conditioning unit can be anywhere between 200 or 300 kPa and 800 to 900 kPa.

This differential pressure is useful to move the liquid refrigerant to the evaporator 37, (especially when the evaporator is disposed at a higher level than the compressor) or to move the oil.

However, when the compressor operates at part-load and the pressure at the economiser port 9 becomes equal or close to the intake pressure, the above mentioned differential pressure tends to disappear and it would, without the invention, become difficult or impossible to move the liquid to the evaporator or respectively the oil to the bearings.

According to the invention, a piston 12 is slidingly and sealingly mounted in an extension 13 of the piping 10 extending from economiser hole to an intake pressure space 19 provided beyond the bearing 3 remote from the motor. Intake pressure space 19 is connected to the intake region 20 through bearing 3 and a longitudinal duct 21 provided through the screw 2. Piston 12 has thus a front face **12*a* subjected to economiser pressure and a back face 12*b*, of equal area, subjected to intake pressure. Piston 12 is biased by a spring 14 so that, in the absence of a differential pressure, piston 12 moves to the position 15 shown in dotted lines, adjacent to a shoulder 16 of the piping 10 and creates therewith a restriction 17**.

Thus, when pressure at the economiser hole 9 falls to intake pressure, the piston moves to a pressure drop is created through the restriction 17 maintaining in the motor housing 7 with respect to the intake pressure, a positive pressure differential sufficient to move refrigerant liquid to the evaporator 37 or the oil to the bearings 3 and 4.

However, when the compressor operates at full-load, the front face **12*a* of the piston 12 is at economiser pressure whereas the back face 12*b*** is subjected to the intake pressure.

The spring 14 is so designed that in the position shown in solid lines, with economiser hole 9 fully cleared by piston 12, the spring load is balanced by a differential pressure equal to a threshold value of about 250 kPa, i.e. if economiser pressure is 25 kPa higher than intake pressure.

In said position, the piston 12 is not creating any pressure drop between the motor and the economiser hole 9. Such a pressure drop would be, as is obvious and well-known, highly detrimental to the efficiency of the compressor.

In the embodiment of FIG. 2, which will be described only as to its differences with respect to that of FIG. 1, the extension 13 is no longer provided, and the piston 12 is located in a bore 39 which is arranged in casing 8 transversely to the axis of the motor-compressor unit, so as to connect piping 10 and intake region 20. Bore 39 is provided with shoulder 16 adapted to cooperate with face **12*a* of piston 12**.

An upstream portion **10*a* of piping 10, extending between motor housing 7 and bore 39, meets bore 39 beyond shoulder 16, whereas a downstream portion 10*b* of piping 10, extending between bore 39 and economiser hole 9, is connected to bore 39 so as to communicate with portion 10*a* through shoulder 16, provided that piston 12 does not rest against shoulder 16. Spring 14 is a traction spring extending through shoulder 16**.

When the pressure at economiser hole 9 is at least 250 kPa higher than intake pressure, piston 12 is repelled against the action of spring 14 and there is a free communication between portions **10*a* and 10*b* of piping 10**.

In the contrary case, spring 14 urges piston 12 towards shoulder 16 and piston 12 forms therewith a pressure regulating restriction, maintaining in portion 10a, and thus in motor housing 7, a pressure substantially 250 kPa higher than the intake pressure.

In the embodiment of FIG. 3, the closure member is a butterfly valve member 112 which is pivotable in piping 10 between portions **10*a* and 10*b* thereof, about a pivotal axis 41 which is laterally spaced from axis 42 of piping 10. Thus, if pressure upstream of valve member 112 (piping portion 10*a*) exceeds pressure downstream of valve member 112 (pipping portion 10b), valve member 112** is biased to open.

A lever 43 rigidly connected to the downstream face of valve member 112 is pivotally and slidably connected to a stem 44 of a piston 46 slidably and sealingly received in a bore 47 extending between portion 10b of piping 10 and intake region 20.

Piston 46 has thus a front face **46*a* subjected to the economiser pressure and a back face 46*b* subjected to the intake pressure. The economiser pressure acts on piston 46 to open valve member 112. The intake pressure together with biasing spring 14 acts on piston 46 to close valve member 112**.

If the economiser pressure is at least e.g. 25 kPa higher than the intake pressure, piston 46 fully opens valve member 112.

In the contrary case, the piston 46-spring 14 combination tends to close the valve member 112. However, this creates in piping portion 10a an overpressure which acts on valve member 112 to slightly open the latter. This regulates the overpressure in piping portion 10a connected to motor-housing 7 (not shown in this figure).

The invention has been described in the case of a single screw compressor but would, without changes, apply to any type of compressor which may be equipped with an economiser hole, especially a fixed economiser hole, e.g. twin screw compressors, movable vane compressors, stationary vane compressors and so on.

In a less efficient embodiment of the invention, the closure member, instead of regulating pressure in the motor housing when the differential pressure at economiser hole is low, could merely create a fixed calibrated passage for gas coming from the motor housing.

The closure member could be of other types than those of the examples which have been described.

I claim:

1. A refrigeration motor-compressor unit comprising a positive displacement rotary compressor driven by a motor, means for injecting refrigerating fluid in an innerspace of the motor for cooling the motor, said innerspace being connected by a piping to an economiser hole of said compressor, a closure means disposed in said piping for at least partially obturating said piping, duct means for subjecting one face of said closure means to an intake pressure of the compressor, said closure means being responsive to a pressure difference between said intake pressure and the pressure at said economiser hole for adjustably restricting flow in said piping when said pressure difference is below a predetermined differential level and for opening said piping when said pressure difference exceeds said predetermined differential level, and biasing means biasing said closure means towards a position of maximum flow area restriction in said piping.

2. A refrigeration motor-compressor unit as claimed in claim 1, wherein said closure means is a slidable piston having a first face subjected to said intake pressure of the compressor, and a second face subjected to the pressure in the motor housing, the stroke of said piston and the strength of the biasing means being so selected that said piston establishes a substantially unrestricted communication between said motor innerspace and said economiser hole when said pressure difference overrides said predetermined differential level.

3. A refrigeration motor-compressor unit as claimed in claim 2 in which a path of fluid from said motor innerspace to said economiser hole extends through a shoulder with which said piston cooperates for providing said flow restriction.

4. A refrigeration motor-compressor unit as claimed in claim 2, wherein said duct means is and extension of said piping connecting the motor innerspace to the economiser hole, said extension extending between the economiser hole and a low pressure space provided at an end of the compressor remote from the motor, and said piston is mounted in said extension at an end thereof which is proximal to the economiser hole.

5. A refrigeration motor-compressor unit as claimed in claim 2, wherein said duct means is a bore extending between said piping and an intake region of the compressor, and said piston is mounted in said bore.

6. A refrigeration motor-compressor unit as claimed in claim 5, wherein said piping comprises two piping portions communicating with each other through a shoulder of said bore, said shoulder being adapted to cooperate with the piston for providing said flow restriction.

7. A refrigeration motor-compressor unit as claimed in claim 1, wherein, when said pressure difference is below said differential level, the closure means is positioned by the equilibrium of forces created by the intake pressure, the pressure in innerspace of the motor and biasing means, so as to regulate the pressure in the motor innerspace by variably restricting flow from motor innerspace towards the economiser hole.

8. A refrigeration motor-compressor unit as claimed in claim 5, wherein said compressor is a screw compressor having an intake region adjacent the motor, and wherein said low pressure space is connected to the intake region through a bearing of the compressor and through a longitudinal duct provided through a screw-rotor of said screw compressor.

* * * * *